US005390513A

United States Patent [19]

Hägel et al.

[11] Patent Number: 5,390,513

[45] Date of Patent: Feb. 21, 1995

[54] WARP KNITTING MACHINE HAVING A GUIDE BAR WITH INDIVIDUALLY MOVABLE THREAD GUIDES MOUNTED THEREON

[75] Inventors: Adolf Hägel; Jürgen Lämmerhirt, both of Bad Steben, Germany

[73] Assignee: LIBA Maschinenfabrik GmbH, Naila, Germany

[21] Appl. No.: 194,252

[22] Filed: Feb. 10, 1994

[30] Foreign Application Priority Data

Feb. 10, 1993 [DE] Germany ..... 4303967

[51] Int. Cl.[6] ..... D04B 27/10; D04B 27/06

[52] U.S. Cl. ..... 66/207; 66/204; 66/214

[58] Field of Search ..... 66/204, 205, 206, 207, 66/208, 214

[56] References Cited

U.S. PATENT DOCUMENTS

| | | | |
|---|---|---|---|
| 3,006,170 | 10/1961 | Chapuis | 66/205 |
| 3,678,711 | 7/1972 | Schneider et al. | 66/205 |
| 3,978,690 | 9/1976 | Beling et al. | 66/205 |
| 4,314,463 | 2/1982 | Fuchs | 66/204 X |
| 4,590,776 | 5/1986 | Bonaschi | 66/205 |
| 5,241,842 | 9/1993 | Hagel | 66/204 |
| 5,295,372 | 3/1994 | Kemper et al. | 66/204 X |

FOREIGN PATENT DOCUMENTS

| | | | |
|---|---|---|---|
| 113375 | 6/1975 | Germany . | |
| 3023952 | 1/1982 | Germany | 66/207 |
| 91/14815 | 10/1991 | WIPO . | |

*Primary Examiner*—Clifford D. Crowder
*Assistant Examiner*—John J. Calvert
*Attorney, Agent, or Firm*—Bell, Seltzer, Park & Gibson

[57] ABSTRACT

Warp knitting machine with a guide bar executing an oscillation movement and a base shift movement. Single thread guides are mounted thereon and are individually movable in a to- and fro- motion in the shift direction and are combineable into one or more groups and are group-wise adjustable by electrically controlled control motors under the influence of a program control having a pattern shift movement stored therein. Each of the control motors is connected to the thread guides of at least one group by a pull control cable held under tension which extends over the length of the guide bar and is further connected to the thread guides such that all thread guides of any one group execute the same pattern shift movement. The control motors are structurally supported independent from the guide bar. The pull control cables are guided from the guide bar at right angles and then deflected toward said motors. Cable guides, which are assigned to a guide bar, are mounted on a carrier which on one side is connected to the guide bar by a tongue in such a manner so that the carrier only follows the base shift movement. Also, the cable guides are arranged at such a distance from the thread guides in the shift direction so that during an oscillation of the thread guides no pattern shift movement in the array of the corresponding pull control cables will occur.

10 Claims, 6 Drawing Sheets

A
A
22
22
22
22
61
61
67
68
68
64
60
60
66
66
57
57
63
63
65
65
67
59
59
56
56
58
58
55
55
33
2
2

WARP KNITTING MACHINE HAVING A GUIDE BAR WITH INDIVIDUALLY MOVABLE THREAD GUIDES MOUNTED THEREON

BACKGROUND OF THE INVENTION

The invention is concerned with a warp knitting machine having movable cable guides on an oscillating guide bar.

Such a warp knitting machine is known from U.S. Pat. No. 5,241,842. An object of the invention is to keep at a minimum the mass moving with the oscillations of a guide bar.

This object is achieved by the characteristics as recited in the following detailed description and in the claims.

The arrangement of cable guides on a carrier which only follows the basic shift movement of a guide bar results in that each cable guide does not participate in the oscillations of the corresponding guide bar or move therewith and, therefore, does not influence the oscillations with its own mass. This is beneficial for the speed of the movements of the guide bar. Because of arranging the cable guides at a relative great distance from the thread guides, a movement of the pull control cables, because of the oscillating movements of the thread guides, will change the deviation angle of the pull control cables very little so that the corresponding extent of movement can be compared with a very short sector of a circle having a large radius.

The measured length between a thread guide and its corresponding cable guide, during an oscillating movement, practically does not change, so that because of the oscillations of the thread guide, a pattern shift movement of the pull control cables does not appear.

Furthermore, a loosening up of the layout of the cable guides results in a corresponding flexible and easily followed further guidance of the pull control cables to the individual control motors which enhances any addition of a larger number of motors.

The cable guides are advantageously in the form of direction changing or deflection rollers.

Preferably, the pull control cables are each under the influence of a spring tension. The spring tension effectively should influence the pull control cable on both of its ends so that during a pattern shift movement cycle, a middle position is being assumed. The pull springs assume a state of equilibrium from which the control motors can adjust the pull control cables in a to- and fro- motion or mode for which very little energy is required because of a small adjustment magnitude, namely, such that a pull on the pull springs barely disturbs the above mentioned equilibrium.

Each of the pull control cables, preferably, is guided over a pretensioned tension roller being provided between a cable guide and a control motor. The tension roller is under the influence of the pull springs by being pulled against an adjustable abutment. By means of the adjustable abutment, a subsequent fine tuning of a corresponding pull control cable and a thread guide connected thereto can be achieved, it is being assumed that the corresponding pull control cable is being connected to a control motor. In this case, the control motor, at least in its own effective sphere, holds onto the pull control cable, so that during a change in the abutment, the length of the pull control cable between the control motor and the thread guide can be varied negligibly. Thereby, a negligible tension is being exerted on the control motor which, however, with regard to the normally small adjustment range, can practically be ignored.

In the case of a manual hang-out of a guide bar and in order to leave the pull control cables unaffected in the area. of the cable guides and the control motors, a cable clamp can be provided in the area of a push rod for the guide bar being effective to hold the pull control cables. In this case, the array of pull control cables remains under tension between the cable clamp and the control motors, so that in this area, no entanglement of the pull control cables can occur.

In order to enable a complete removal of the guide bar, hook couplings are provided in the pull control cables, preferably, in the area extending between the cable clamp and the guide bar, the couplings constituting through connectors. In the event of a complete removal of the guide bar from the machine, the hook couplings are unhooked. Upon the reinstallation of the guide bar, the hook couplings are merely reconnected and the cable clamp is loosened, whereby the overall arrangement of the pull control cables is functional again.

DETAILED DESCRIPTION OF THE PREFERRED EMBODIMENT

Figure 1:
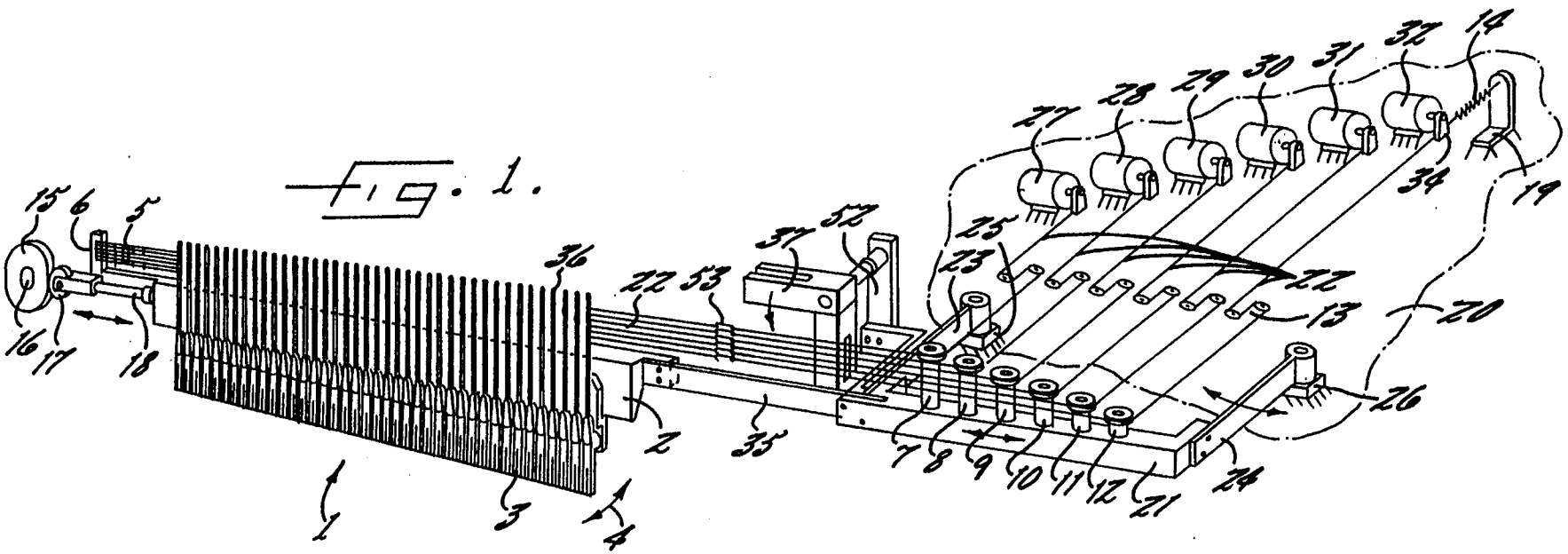
FIG. 1 shows a perspective view of a guide bar of a warp knitting machine with group-wise arranged thread guides and the corresponding pull control cables as well as the control motors activating the same without showing the common elements of the known warp knitting machine.

FIG. 1 shows a guide bar 1 of a warp knitting machine with the other known elements of a warp knitting machine having been omitted. The guide bar 1 includes a carrier 2 for the thread guides 3 formed as apertured needles and being movable to and fro in a shift direction. The thread guides 3 swing in a known manner through needle spaces between the knitting needles of the involved warp knitting machine. The in shift direction to- and fro- moving guide bar 1, which is hereby designated as the base shift movement, is indicated by the drawn arrow adjacent to the push rod 18. The function of push rod 18 will be described in detail below. The oscillating movement of thread guide 3 is illustrated by the curved arrow 4, which is shown on the right end of guide bar 3. The illustration of the knitting needles in the drawing of FIG. 1 has been omitted because the cooperation between knitting needles and thread guides of a warp knitting machine is known since the existence of warp knitting machines.

For the execution of an oscillating movement of guide bar 1 and the thread guides 3 mounted thereon, carrier arms are used as is commonly known. With regard to the suspension of the guide bar 1, reference is being made to the description of U.S. Pat. No. 5,241,842, cited above. The base shift movement of guide bar 1 is caused by push rod 18 which at its end presses against the guide bar 1 and with its other end presses against the eccentric 15. As the eccentric 15 rotates around its axle 16, the eccentric pushes the roller 17 to and fro, whereby the roller 17 transfers its movement in shift direction to the push rod 18 and thereby to the guide bar 1. While the to- and fro- movement of the guide 1 (base shift movement), being induced by eccentric 15, is occurring, the thread guides 3 undergo the prevailing process of swinging through differing needle spaces (according to double arrow 4), whereby the predetermined and desired appearance or texture of the knitted material is obtained.

The thread guides 3 are connected in groups with at least one of the six illustrated pull control cables 22, so that, in the later described to- and fro- movement of one of the pull control cables 22, all of the thread guides 3 connected to this particular pull control cable are being moved to and fro, correspondingly, meaning a corresponding pattern shift movement, so that it is finally superimposed over the base shift movement. When undergoing this pattern shift movement, the thread guides 3 move from a normal position into a pattern position and back as is being described in detail in U.S. Pat. No. 5,241,842. When in a normal position, the thread guides 3 lay their threads in an even manner resulting in even stitch patterns in the fabric. However, in order to convey a pattern to the knitted material, the thread guides 3 are moved from their normal position into a pattern position (under the execution of a pattern shift movement).

The pattern shift movement imposed on the thread guides 3 emanates from the pull control cables 22 which on one end, by way of the pull springs 5, are connected to the angle iron 6 which is rigidly connected with the carrier 2 which in turn is connected with guide bar 1. Each of the pull control cables thereafter is guided along the length of guide bar 1 to a corresponding deflection roller 7–12 from where the pull control cables are deflected to a corresponding control motor 27–32. The tension roller devices 13, which are located between deflection rollers 7–12 and the control motors 27–32, will be explained in more detail below. The control motors 27–32 controlled from a program control 33 having a pattern program stored therein which, in a known manner, can be matched with any desired mandates of a pattern or can be rearranged. The control motors 27–32 carry on each of their axles an oscillation arm 34 which oscillates upon each turning of the axle of the control motor, for example, an angle of a few degrees, which arm will take along the corresponding pull control cable 22 fastened at its end. For this purpose, the pull control cables 22 are fastened to the ends of the oscillation arms 34, by clamping, for example. The pull control cables 22 continue from the oscillation arms 34 and end at the pull springs 14 which in turn are connected to the angle irons 19.

The control motors 27–32 and the angle iron 19 are arranged in a stationary manner and for this purpose are rigidly fastened to some element 20 of the machine frame. This could take the form of a plate or a larger angle iron being fastened to the machine frame in some manner. The machine element 20 is shown in a dot-dash broken line.

The deflection rollers 7–12 are supported on carrier 21. The carrier 21 itself is carried on one side by a blade spring 23 and on its other side by a blade spring 24. Both blade springs 23 and 24 are supported on stationary studs 25 and 26 which in turn are supported on machine element 20. Moreover, the carrier 21 is in connection with bar 2 by way of tongue 35 which transfers the shift movement of bar 2, completely onto the carrier 21 which on both of its ends is held by the blade springs 23 and 24 in such a manner that it can undergo a longitudinal shifting. Involved here is a movement in the magnitude of only a few millimeters, so that, when considering the lengths of the blade springs 23 and 24, practically no change in spacing between the deflection rollers 7–12 and the control motors 27–32 will occur. The additional oscillation movement impressed on guide bar 1, see double arrow, cannot transfer itself to carrier 21 because, as mentioned above, carrier 21 is on one hand carried by the blade springs 23 and 24 and on the other hand is connected to the tongue 35. The tongue 35 undergoes a bending movement induced by the swing movement of the guide bar 2 and because of its inherent elasticity, and it additionally is subjected to a minimal twisting at its end facing bar 2. When considering the length of the tongue 35 such as 500 mm, for example, and the oscillating movement of bar 2 of a length of approximately 20 mm in the area of the corresponding end of the tongue 35, a minimal twisting of the tongue 35 will occur. In effect, the carrier 21, in spite of the oscillation movement of the guide bar 2, substantially only executes a linear movement in a to- and fro- motion in a longitudinal direction of carrier 21, so that during a shifting movement and an oscillation movement of the guide bar 1 and the almost linear to- and fro- movement of the carrier 21, no discernible shifting of the pull control cables 22 in the area of their connection with arms 36 can be observed.

As shown in FIG. 1, the individual pull control cables 22 are each connected to several arms 36 of thread guides 3. This connection can be achieved, for example, by clamping by using clamping screws. Thereby, any at will distribution of the individual arms 36 relative to the pull control cables along the entire length of guide bar 1 is possible, so that the fastening of the arms 36 to one pull control cable but in resulting groups of thread guides 3, can be mixed in any manner and be distributed at will over the whole of guide bar 1. This results in a further possible variation with regard to a patterning on the material. Additionally, of course, the patterning can be influenced by the program controller 33.

Both pull springs 5 and 14 are adjusted in such a manner that the tensile forces cancel each other, whereby the arm 34 of a control motor 27–32 and having a pull control cable connected thereto, remains in at-rest position without having to rely on any force from the control motor to keep the same in the at-rest position. This can be achieved by way of an initial adjustment wherein in a pre-conditioning of an adjusted tension of both springs 5 and 14 is achieved first and then the arm 34 is clamped to the pull control cable while in its at-rest position. The springs 5 and 14, for this purpose, can also be adjusted by adjusting screws (not shown). Upon a movement of arms 34 based on a corresponding influence of the control motors 27–32 from the program control (not shown), the arms 34 have to exert a relative small force only to minimally move the pull control cables 22 out of their at-rest position and the springs 5 and 14 out of their state of equilibrium by only a few millimeters, for example, whereby a minimal tensile force has to be overcome, namely, on the side of the spring that is being extended.

The above descriptions show that despite the presence of a substantial mechanism to be used in the pattern mandated adjustments of the thread guides 3 in the sense of pattern shift movements, the guide bar 1 is only minimally burdened by additional machine elements, namely, only the angle iron 6, the arms 36 will pull control cables belonging thereto and the tongue 35, so that with regard to the oscillating movement of the guide bar 1, substantially no additional mass inertia has created. With regard to the oscillation movement of the guide bar 1, no substantial machine speed inhibiting factors are present. Furthermore, FIG. 1 clearly shows the neat grouping of the control motors 27–32 and the pull control cables 22, which proves to be advantageous for the provision of a greater number of control motors.

Figure 4A:
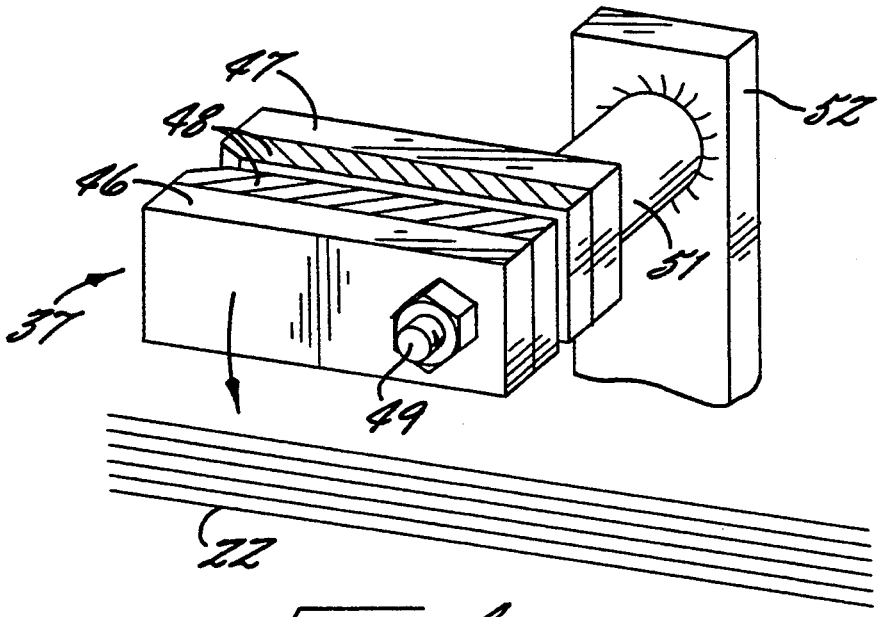
FIGS. 4*a* and 4*b* show a cable clamp for holding the pull control cables in a state of non-operation and a clamping state, respectively.

In FIG. 1 is also shown a cable clamp 37 which in connection with FIGS. 4*a* and *b* will be closer described.

Figure 2:
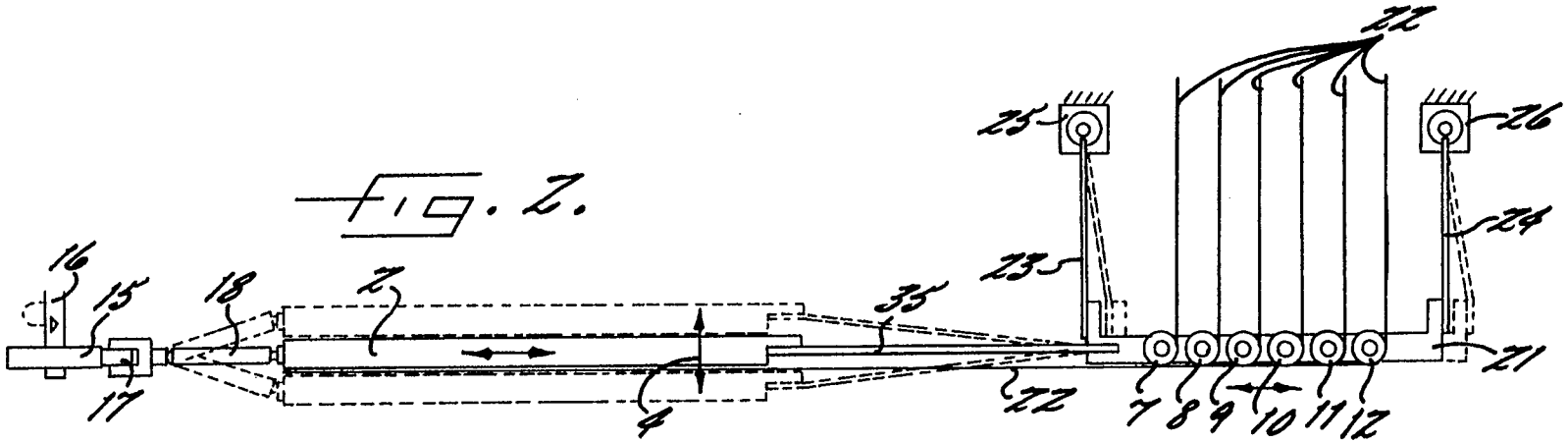
FIG. 2 is a top view of the arrangement of the pull control cables according to FIG. 1, without the control motors.

FIG. 2 shows a top view of the arrangement according to FIG. 1, however, with the omission of control motors 27–32 and the tension roller devices 13. As can be seen, when the bar 2 is in a base shift movement, the blade springs 23 and 24 are bent sideways to thereby assume the dashed line indicated position which obviously does not practically change the spacing of the carrier 21 relative to the studs 25 and 26. During the oscillation movement of the bar 2, as is indicated by double arrow 4, again a minimal bending of the tongue 35 is occurring, which is indicated by the dashed lines. This bending is illustrated in an exaggerated manner to emphasize the fact that practically no twisting of the tongue 35, in the area where it is being fastened to the bar 2, is occurring. As already mentioned above, the length of the oscillation movement, when measured tangentially to the thread guides, amounts to only a few millimeters, whereby the length of the tongue 35 is measured at about 500 millimeters.

Figure 3:
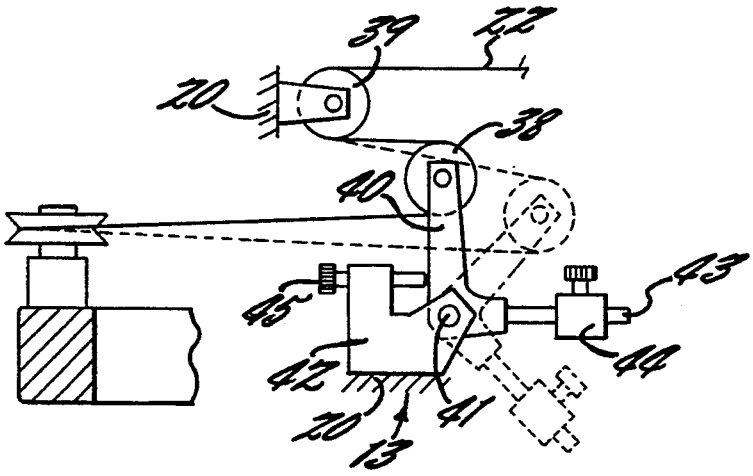
FIG. 3 shows a tension roller for a pull control cable with its influencing mechanism.

FIG. 3 shows the in FIG. 1 schematically indicated tension roller arrangement 13 through which the pull control cable 22 is guided. The tension roller arrangement 13 consists of the tension roller 38 and the stationary roller 39 which is fastened to the stationary frame element 20. The tension roller 38 is supported on the angled lever 40 which in turn is supported by axle 41. The axle 41 is located in carrier element 42 which also is stationarily supported on frame element 20. The angled lever 40 is loaded on its arm 43 by means of a movably supported weight 44 (dead weight), so that the tension roller 38 is being pulled away from the stationary roller 39 under the influence of weight 44. In its normal position, the tension roller 38 is pulled against the abutment screw 45 by means of the in FIG. 1 illustrated springs 5 and 14, which abutment screw through a corresponding rotation allows an adjustment of the tension roller 38 relative to the stationary roller 39. By approaching and moving away the tension roller 38 relative to the stationary roller 39 under the influence of an adjustment of the abutment screw 45, a shortening and lengthening of the pull control cable 22, in the area between the control motors 27–32 and the deflection rollers 7–12, is achieved. This will effectively increase or decrease the tension of springs 5 and 14, whereby, simultaneously, a position shift of the pull control cable 22 in the area of the guide bar 1 is occurring. In this manner and by means of an adjustment of the abutment screw 45, an adjustment of the position of the arms 36 on bar 2 is obtained and thereby a fine adjustment of the individual thread guides relative to the not illustrated knitting needles and the spaces therebetween is achieved.

In FIG. 3, by way of the dashed lines, still a further position of the tension roller 38 is illustrated in which the angled lever 40 is distanced from the abutment screw 45. This is an operational state of the corresponding warp knitting machine when it is not in a working mode, when, for example, adjustments or other operations are performed. It can happen, for example, that during some manual intervention, a loosening of corresponding pull control cables can occur, whereby the cables can slip out of guides or their corresponding deflection rollers 7–12. In order to minimize or avoid such a problem, the tension roller 38, under the effect of the weight 44, is kept under an at-rest tension in the corresponding pull control cables even in a non-operational state.

The weight 44, being movable on arm 43, is of such magnitude so that, as illustrated above, it can be overcome by the force of the springs 5 and 14 and so that in its operational state, the angled lever 40 abuts against the abutment screw 45. As needed, the weight 44 on arm 43 is correspondingly adjustable. It is noted, that the weight 44, of course, could be replaced by some tension spring.

Figure 4B:
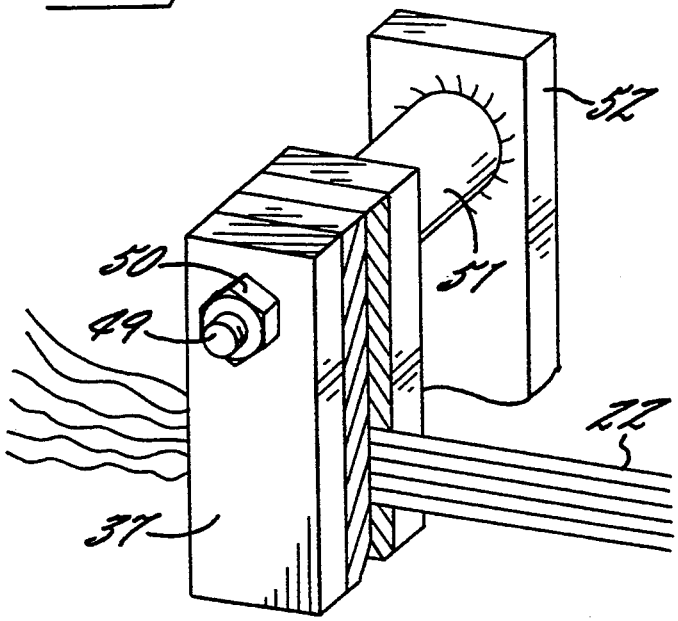
Figures 6, 7:
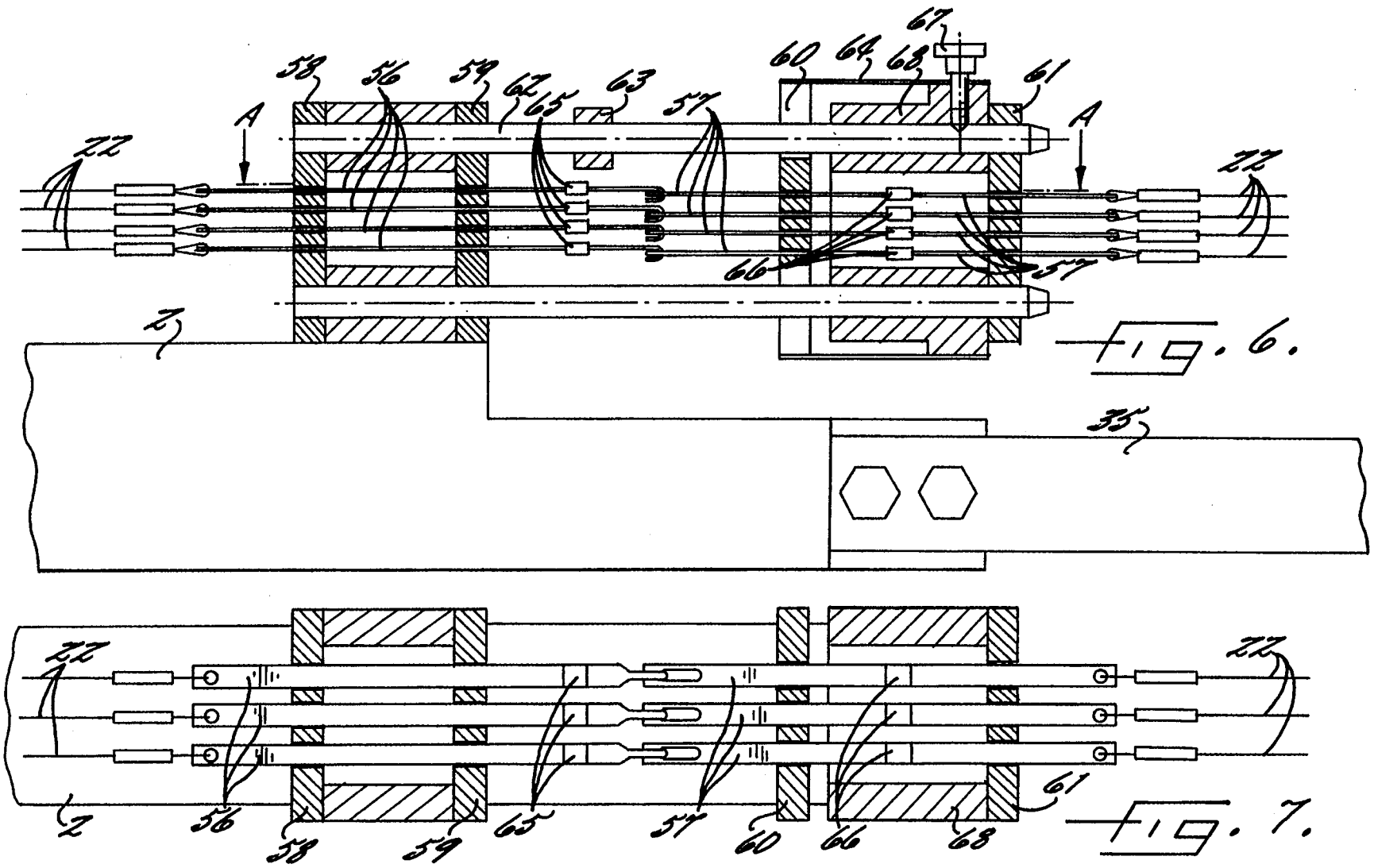
FIG. 6 shows a multiple line cable coupling in an operational state.
FIG. 7 shows a section along Line A—A of FIG. 6 of the multiline coupling.
Figure 8:
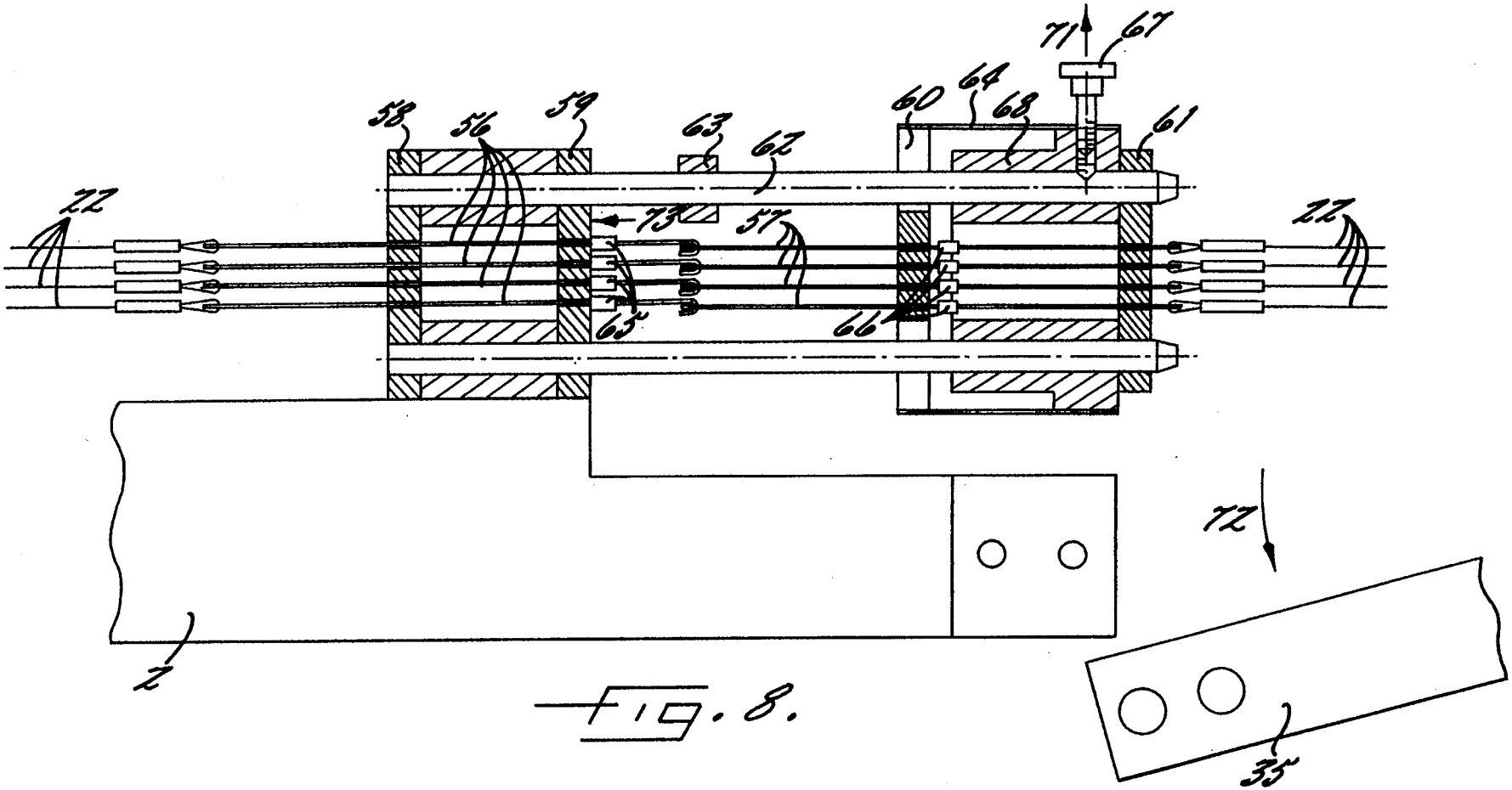
FIGS. 8 and 9 show a step-wise decoupling process.
Figure 9:
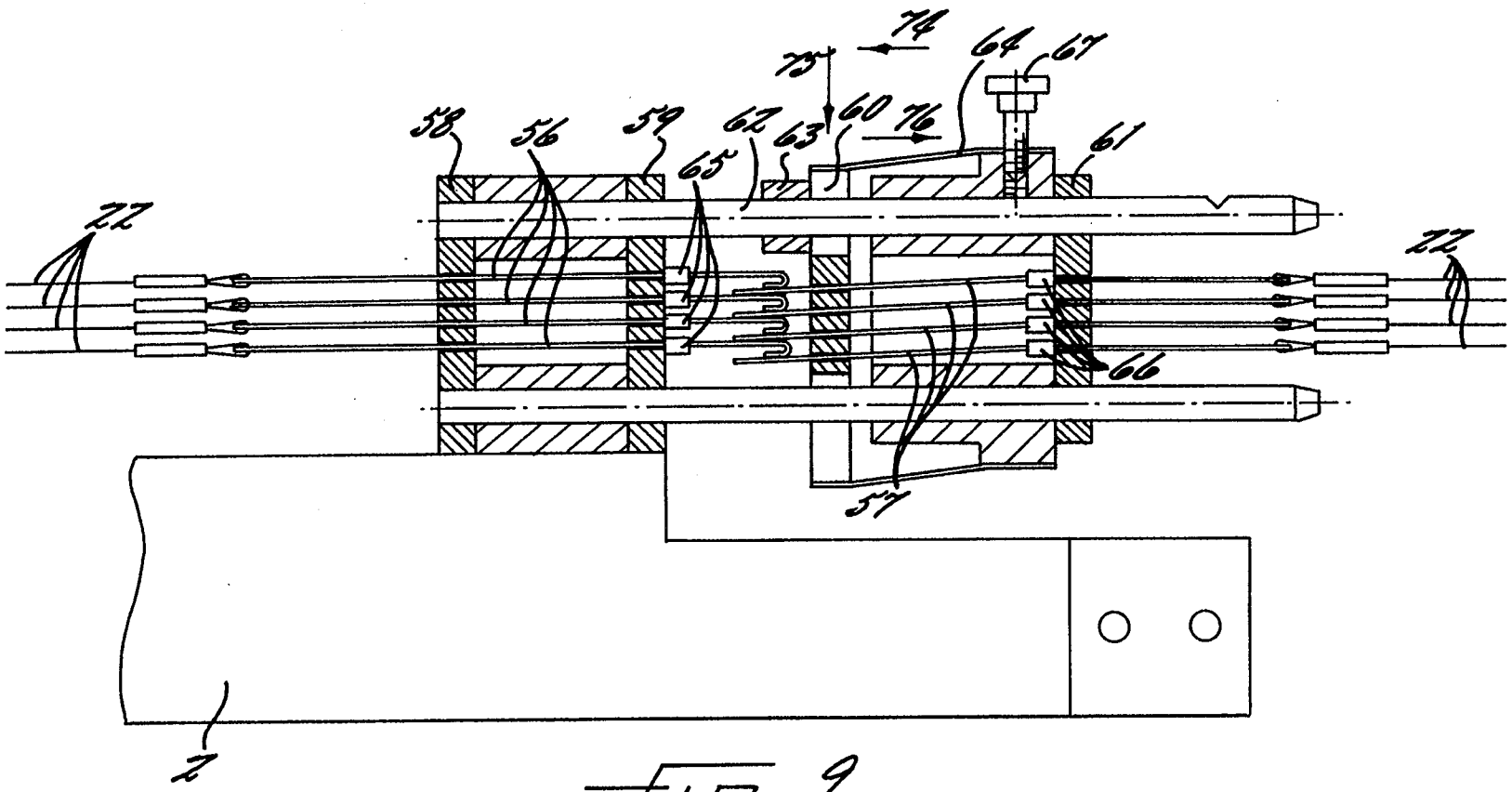

In order to perform any manual work on the arrangement as shown in FIG. 1, such as on the pattern device or the guide bar 1, and in order to maintain the tension on the pull control cables to some extent, a cable clamp 37 is provided which is illustrated in FIGS. 4*a* and 4*b*. FIG. 4*a* shows a non-operational state (non-tensioned pull control cables 22) and FIG. 4*b* shows a clamping position. The cable clamp 37 includes the two jaws 46 and 47 which are provided with a soft clamping layer 48. Cable clamp 37, shown in FIG. 4*a* in its non-operational position, can be rotated about its shaft 49, so that the pull control cable 22, being guided above a location of the tongue 35, can be received between the jaws 46 and 47, as is illustrated in FIG. 4*b*. In order to obtain a clamping, nut 50 provided on shaft 49, is rotated until both jaws 46 and 47 have sufficiently approached each other. The shaft 49 of cable clamp 39 ends in a support part 51 which by means of support 52 is fastened to carrier 21.

By clamping the pull control cables 22, the cables, extending between the deflection rollers 7–12 and control motors 27–32, are held under tension so that, in the area of guide bar 1, some manual work can be undertaken including a hang-out of the guide bar.

Figure 5:
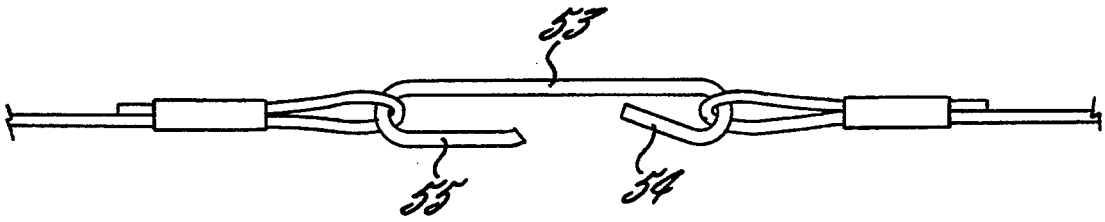
FIG. 5 shows a hook coupling.

In order to accomplish a complete removal of guide bar 1, the pull control cables 22 extending in the area between cable clamp 37 and the guide bar 1, are being provided with hang couplings 53. The hang couplings, according to FIG. 5, consist on one end of an eyelet 54 receiving a corresponding one end of part of a pull control cable and on the end is provided with a hook 55 wherein the corresponding end of the other part of the pull control cable can be received or removed. In the event of a complete removal of the guide bar 1, and as illustrated above, the cable clamp 37 is moved into its clamping position, and thereafter, the hang couplings 53 are unhooked. The guide bar 1 can be completely removed from the patterning arrangement. The location of the hang couplings 53 in the overall system is indicated as 53 in FIG. 1.

In place of the hang couplings 53, a multiple cable coupling can be provided. This accomplishes a simultaneous coupling and decoupling of several pull control cables. The part of the pull control cables 22 facing the side of the guide bar is fastened to a hook plate 56. The part of the pull control cables 22 facing toward the control motors is fastened to a hole plate 57. In its operational position, the hook plate 56 is hooked into the hole plate 57 and thereby accomplishes the transmission of pull forces. Both plates are each guided between guides 58 and 59 and 60 and 61, respectively, and possess a degree of movement in an axial direction only.

During the decoupling process, the set screw 67 is being loosened, initially (arrow 71). Thereafter, the sled 68 is being moved in an axial direction of guide rods 62. After the removal of tongue 35 (arrow 72), the pull control cables 22 are being pulled to the left by pull springs 5. An abutment 65 on the hook plate limits this process. All hook plates are thereby evenly positioned in an axial direction.

Thereafter, the sled 68 can manually be moved to the left (arrow 74). An abutment on the hole plates results in an even positioning of the hole plates. After the adjustable abutment 63 arrives, the guide plate 60, which is suspended from the blade spring 64, is pushed downwardly (arrow 75). By moving the sled 68 to the right (arrow 76), the guide plate 60 is further pushed downwardly and a complete separation of both plates occurs. The sled 68 is now being removed from the guide rods. The guide bar 2 has now been separated from the pull control cables and can be removed from the machine. The recoupling is accomplished in reverse order.

That which is claimed is:

1. A warp knitting machine having at least one guide bar (1) executing an oscillation movement and a base shift movement including thread guides (3) supported on said guide bar (1) and being individually movably adjustable in a to- and fro- motion in said base shift direction and being arranged to form one or more groups and being movable in a group in a pattern shift movement by a program control over an electrically controlled control motor (27–32), said motor being connected to said thread guides (3) of said one or more groups by at least one pull control cable (22) being held under tension, at least two pull control cables (22) are provided and extending over the length of said guide bar (1) and being connected to said thread guides (3) such that all said thread guides (3) of said one or more groups execute an equal pattern shift movement impressed upon said pull control cables (22) by said control motors (27–32), said control motors being mounted structurally independent from said guide bar (1), said pull control cables (22) being deflected by cable guides substantially at right angles to a shift direction of said guide bar (1) toward said control motors (27–32), said cable guides being mounted on a carrier, means for connecting one side of said guide bar (1) to said carrier (21), said means for connecting comprising a tongue (35) and being connected between said guide bar (1) and said carrier (21) in such a manner that the carrier (21) only follows the base shift movement of said guide bar (1) without oscillation movement, wherein the cable guides (7–12) are arranged at such a distance from said thread guides (3) so that, while in a shift movement, practically no pattern shift movement in an array of the corresponding pull control cables (22) will occur.

2. Warp knitting machine according to claim 1, wherein said cable guides (7–12) are formed as deflection rollers.

3. Warp knitting machine according to claim 1, wherein the pull control cables are under spring tension.

4. Warp knitting machine according to claim 2, wherein the pull control cables are under spring tension.

5. Warp knitting machine according to claim 3, wherein said spring tension is effective on both ends of said pull control cables (22) in such a manner that said pull control cables assume a state of equilibrium within a cycle of a pattern shift movement.

6. Warp knitting machine according to claim 4, wherein said spring tension is effective on both ends of said pull control cables (22) in such a manner that said pull control cables assume a state of equilibrium within a cycle of a pattern shift movement.

7. Warp knitting machine according to claim 1, wherein each of said pull control cables (22) is guided over a tension roller (38) located between said cable guide (7–12) and said control motor (27–32), said guide roller (38) being pulled against an adjustable abutment screw (45) under the influence of pull springs (5, 14).

8. Warp knitting machine according to claim 1, wherein in an area of said tongue (35) a cable clamp (37) for clamping said pull control cables (22) is provided.

9. Warp knitting machine according to claim 8, wherein in an area extending between said cable clamps (37) and said guide bar (1), said pull control cables are through-connected by hang couplings (53).

10. Warp knitting machine according to claim 1, wherein in an area extending between said cable guides (7–12) and said guide bar (1), said pull control cables (22) are connected by a multiple cable coupling having means for coupling and decoupling all pull control cables simultaneously.

* * * * *